US010891920B2

(12) United States Patent
Tung et al.

(10) Patent No.: US 10,891,920 B2
(45) Date of Patent: Jan. 12, 2021

(54) SCENARIO PROJECTION SYSTEM AND CONTROLLING METHOD THEREOF

(71) Applicant: Au Optronics Corporation, Hsinchu (TW)

(72) Inventors: Kuan-Yu Tung, Hsinchu (TW); Wang-Shuo Kao, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/430,442

(22) Filed: Jun. 4, 2019

(65) Prior Publication Data

US 2020/0058268 A1 Feb. 20, 2020

(30) Foreign Application Priority Data

Aug. 15, 2018 (TW) ..... 107128513 A

(51) Int. Cl.
*G09G 5/10* (2006.01)
*F21V 7/00* (2006.01)
(Continued)

(52) U.S. Cl.
CPC ..... *G09G 5/10* (2013.01); *F21V 7/00* (2013.01); *F21V 14/02* (2013.01); *F21V 21/14* (2013.01); *G09G 3/2092* (2013.01); *G09G 2310/08* (2013.01); *G09G 2320/0233* (2013.01); *G09G 2320/103* (2013.01); *G09G 2360/144* (2013.01)

(58) Field of Classification Search
CPC .. G09G 5/10; G09G 3/2092; G09G 2320/103; G09G 2360/144; G09G 2310/08; G09G 2320/0233; G09G 3/002; G09G 3/003; G09G 5/12; G09G 3/3406; G09G 3/20; G09G 5/00; G09G 2320/062; G09G 5/02; F21V 21/14; F21V 14/02;
(Continued)

(56) References Cited

U.S. PATENT DOCUMENTS 6,986,581 B2 1/2006 Sun et al.
9,357,613 B2 5/2016 Van Hoof et al.
(Continued)

FOREIGN PATENT DOCUMENTS

CN 1373560 10/2002
CN 102934523 2/2013
(Continued)

OTHER PUBLICATIONS

TECH2IPO, "Atmoph Window," Jul. 6, 2015, Available at: https://www.hksilicon.com/articles/830890.

*Primary Examiner* — Xilin Guo
(74) *Attorney, Agent, or Firm* — JCIPRNET

(57) ABSTRACT

A scenario projection system and a controlling method thereof are provided. The scenario projection system includes a display device, a reflective device and a scenario light source. The display device is configured to show an image on the screen area of the display device. The scenario light source disposed on a slide rail is to project a scenario beam to the screen area where the reflective device is disposed within. The reflected scenario beam by the reflective device is to form a characteristic image outside the screen area, wherein there is a linkage relationship between the image and the characteristic image.

20 Claims, 8 Drawing Sheets

(51) Int. Cl.

| | |
|---|---|
| ***F21V 14/02*** | (2006.01) |
| ***F21V 21/14*** | (2006.01) |
| ***G09G 3/20*** | (2006.01) |

(58) Field of Classification Search
CPC ... F21V 7/00; F21V 7/04; F21V 7/066; F21V 13/04; G02B 6/0031
See application file for complete search history.

(56) References Cited

U.S. PATENT DOCUMENTS

| | | | | |
|---|---|---|---|---|
| 10,197,255 | B2 | 2/2019 | Chien et al. | |
| 2005/0185251 | A1* | 8/2005 | Shreeve ..... | H04N 5/7416 359/291 |
| 2007/0222996 | A1* | 9/2007 | Guan ..... | G01N 21/553 356/445 |
| 2008/0305713 | A1 | 12/2008 | Cortenraad | |
| 2013/0088154 | A1 | 4/2013 | Van Hoof et al. | |
| 2017/0041579 | A1 | 2/2017 | Hung et al. | |
| 2017/0184950 | A1 | 6/2017 | Huang et al. | |
| 2018/0128468 | A1 | 5/2018 | Chien et al. | |

FOREIGN PATENT DOCUMENTS

| | | |
|---|---|---|
| CN | 103945122 | 7/2014 |
| CN | 203827437 | 9/2014 |
| CN | 204009347 | 12/2014 |
| TW | 200800345 | 1/2008 |
| TW | 201818019 | 5/2018 |

* cited by examiner

SCENARIO PROJECTION SYSTEM AND CONTROLLING METHOD THEREOF

CROSS-REFERENCE TO RELATED APPLICATION

This application claims the priority benefit of Taiwan application serial no. 107128513, filed on Aug. 15, 2018. The entirety of the above-mentioned patent application is hereby incorporated by reference herein and made a part of this specification.

BACKGROUND

Technical Field

The disclosure relates to a projection technique, and more particularly to a scenario projection system and a controlling method thereof.

Description of Related Art

Flat-panel displays can present images exquisitely, so they are commonly used in daily life; for example, flat-panel displays may be used as virtual windows or for creating virtual scenes. However, the real scenery often has a directional light source, such as sunlight or street lights, and the directional light source in the real scenery can cause light-shadow variation along with the indoor space. However, the light source of the flat-panel display has a scattering field pattern and thus unable to exhibit light-shadow interaction between the directional light source and space when displaying scenery, which reduces the sense of reality felt by the user.

In view of the foregoing, it is an issue for practitioners of the field to find out how to improve the sense of reality felt by the user.

SUMMARY

In view of foregoing, the disclosure provides a scenario projection system and a controlling method thereof, which utilizes the interaction between the display device and the projection device so that light and shadow in the image could be extended beyond the screen area of the display device, the space where the viewer is located, so that the viewer can feel the light from the image and the image realism of virtual scenery can be improved.

An embodiment of the disclosure provides a scenario projection system, including: a display device, a reflective device, and a scenario light source. The display device is used to display an image in the screen area of the display device. The reflective device is configured in the screen area. The scenario light source is configured on the slide rail to project the scenario beam to the screen area, and the scenario beam is reflected by the reflective device to form a characteristic image outside the screen area, wherein the characteristic image has a linkage relationship with the above image.

An embodiment of the disclosure provides a controlling method of a scenario projection system. The scenario projection system includes a display device, a reflective device disposed in a screen area of the display device, and a scenario light source configured on the slide rail. The controlling method includes: making a screen area to display an image; making the scenario light source to project the scenario beam to the screen area, and the scenario beam is reflected by the reflective device to form a characteristic image outside the screen area, wherein the characteristic image has a linkage relationship with the above image.

Based on the above, in the scenario projection system and the controlling method of the embodiment of the disclosure, the screen area of the display device is provided with a reflective device, and the projection device provides the scenario beam to the reflective device, and the reflected scenario beam may serve as the beam emitted by directional light source within the image and the extended light-shadow relationship from the image can be exhibited, such that the realism of the scenario projection system can be improved.

In order to make the aforementioned features and advantages of the disclosure more comprehensible, embodiments accompanying figures are described in detail below.

DESCRIPTION OF THE EMBODIMENTS

The embodiments of the disclosure are disclosed in the following drawings, and for the purpose of clarity, details for implementation are incorporated below. However, it should be understood that the details are not intended to limit the scope of disclosure. That is, in some embodiments of the disclosure, these details are not necessarily required. Moreover, for simplicity of the drawings, some of the conventional structures and components are described in a simplified schematic manner.

The technical contents, characteristics and advantages of the disclosure are clearly described in the following detailed preferred embodiments with reference to drawings. The directional terms mentioned in the following embodiments, for example, up, down, left, right, front or back, etc., are only directions referred in the accompanying drawings. Therefore, the directional terminologies used are for the purpose of illustration and not limitation. Throughout the specification, the same reference symbols denote the same elements.

Figure 1:
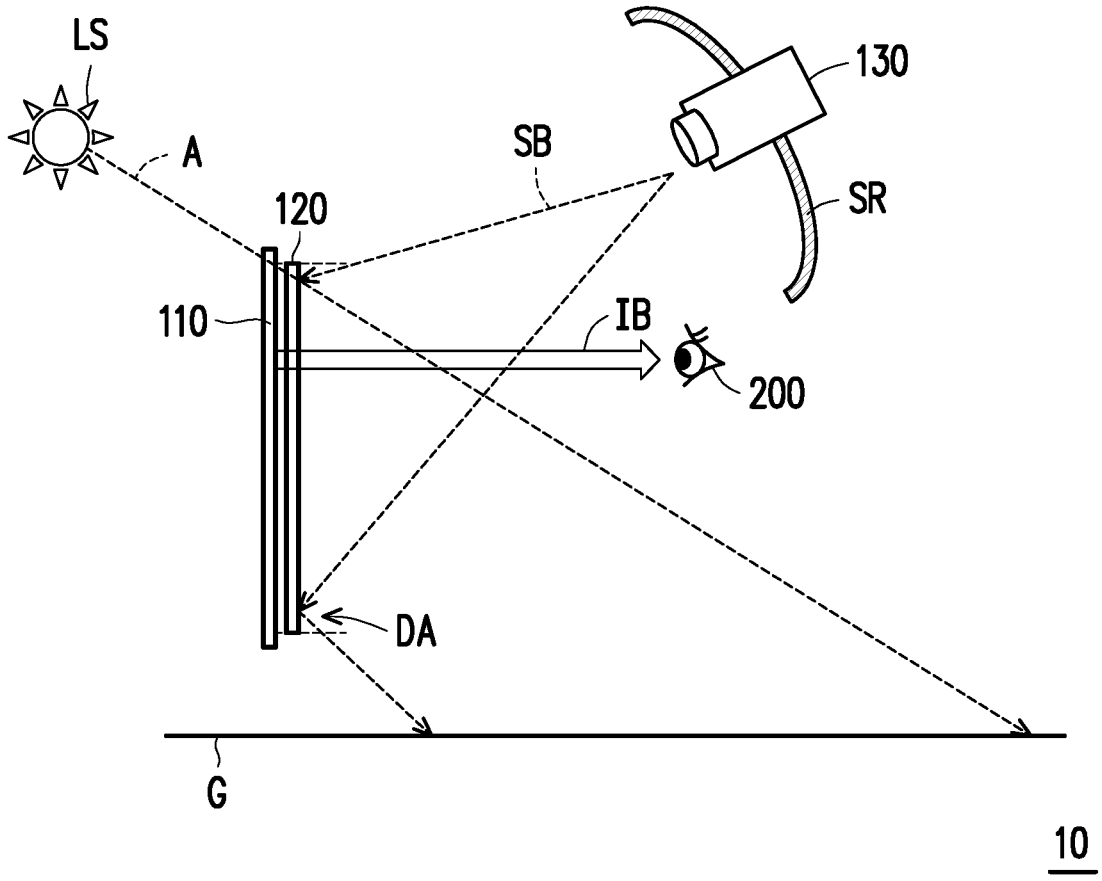
FIG. 1 is a schematic structure diagram showing a scenario projection system according to an embodiment of the disclosure.
Figure 2:
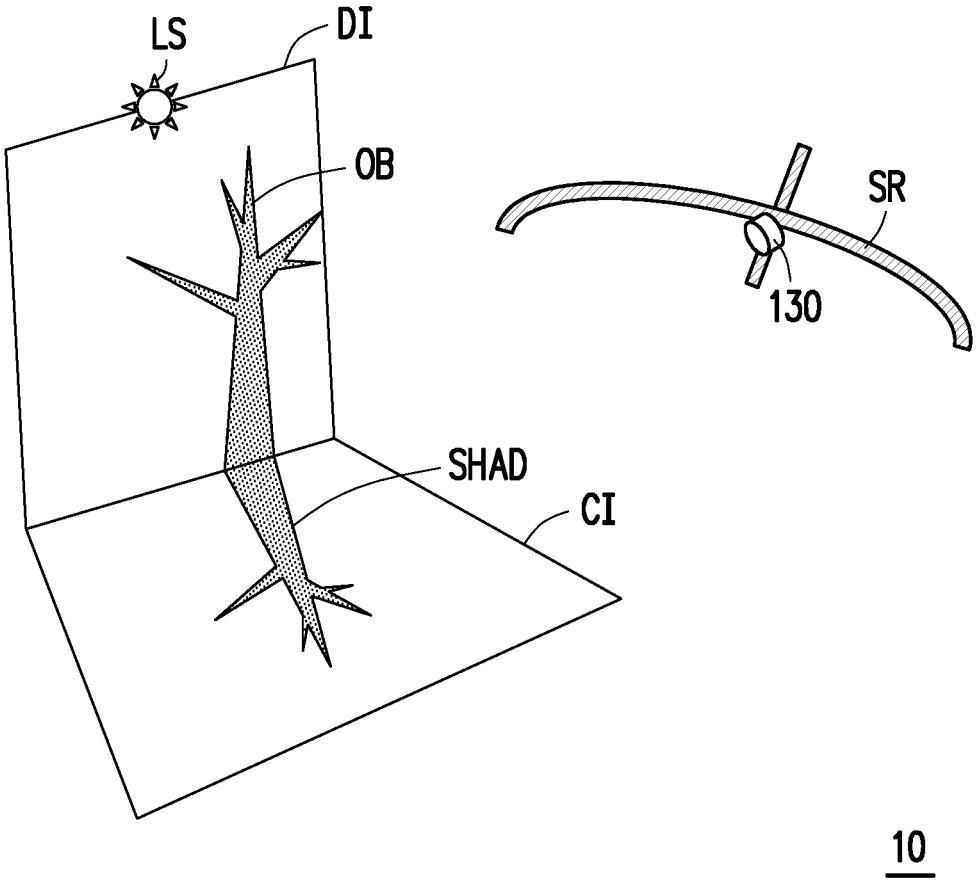
FIG. 2 is a schematic view showing an implementation of a scenario projection system according to an embodiment of the disclosure.

FIG. 1 is a schematic structure diagram showing a scenario projection system according to an embodiment of the disclosure. FIG. 2 is a schematic view showing an implementation of a scenario projection system according to an embodiment of the disclosure. Referring to FIG. 1 and FIG. 2, a scenario projection system 10 includes a display device 110, a reflective device 120, and a scenario light source 130. The display device 110 transmits an image beam IB to the eyes of a viewer 200 for displaying an image DI in the screen area DA. The image DI may include a light source object LS and at least one object OB, the light source object LS may be shown directly within the image DI or may not be shown within the image DI. For example, the sun in FIG. 2 is the light source object LS and the tree is the object OB. However, persons of ordinary skill in the art can understand from the light-shadow variation in the image DI that there should be a light source object LS.

The scenario light source 130 is, for example, a projection lamp or a projector, but is not limited thereto, and is configured on a slide rail SR for projecting a scenario beam SB to a screen area DA. The scenario beam SB is, for example, a monochromatic beam and has directivity. The projecting position of the scenario light source 130 on the slide rail SR corresponds to a mirror position of the light source object LS relative to the screen area DA, so that the scenario beam SB simulates the light emitted by the light source object LS, as shown by light A. In the embodiment, the light source object LS represents the sun, so the scenario light source 130 emits a directional beam. The slide rail SR is disposed above the opposite of the display device 110, the projecting position of the scenario light source 130 disposed on the slide rail SR is higher than the display device 110, and the optical axis of the scenario beam SB is aligned with the center of the screen area DA, so that the scenario beam SB simulates the light-shadow phenomenon as the sunlight is illuminated on the trees.

The reflective device 120 is configured in the screen area DA. The reflective device 120 allows the image beam IB to pass through or its configuration does not hinder the image beam IB from being transmitted, but the reflective device 120 reflects the scenario beam SB, and the scenario beam SB is reflected by the reflective device 120 to form a characteristic image CI outside the screen area DA. Specifically, the characteristic image CI has a linkage relationship with the image DI. In the embodiment, the linkage relationship refers to that the characteristic image CI displays the light-shadow variation caused by the light source object LS to the object OB. For example, the scenario beam SB in FIG. 1 and FIG. 2 is reflected onto the ground G, and a shadow SHAD of the object OB is displayed on the ground.

It should be noted that, in the embodiment, the transmitting direction of the reflected scenario beam SB is different from the image beam IB. The image beam IB is directly transmitted to the eyes of the viewer 200, whereas the scenario beam SB enters the eyes of the viewer 200 after being reflected at least two times by the reflective device 120 and the ground G (which may be other objects in the space such as a desk or a cabinet). Herein, the plane of the image DI is perpendicular to the plane of the characteristic image CI.

An implementation way of the scenario projection system 10 is described in detail below with reference to other embodiments.

Specifically, the display device 110 is, for example, a liquid crystal display (LCD), a light-emitting diode (LED) display, a field emission display (FED) or other types of displays.

The reflective device 120 may be a multi-layer coating structure disposed throughout the screen area DA, allowing the image beam IB to penetrate, but reflecting the scenario beam SB. The reflective device 120 may be configured inside the display device 110. In other embodiments, the reflective device 120 is implemented by changing the liquid crystal structure in the display panel, thereby controlling the reflectivity and the transmittance. The reflective device 120 may also be a reflective area structure in a transflective display. The disclosure provides no limitation to the implementation of the reflective device 120.

Figure 3:
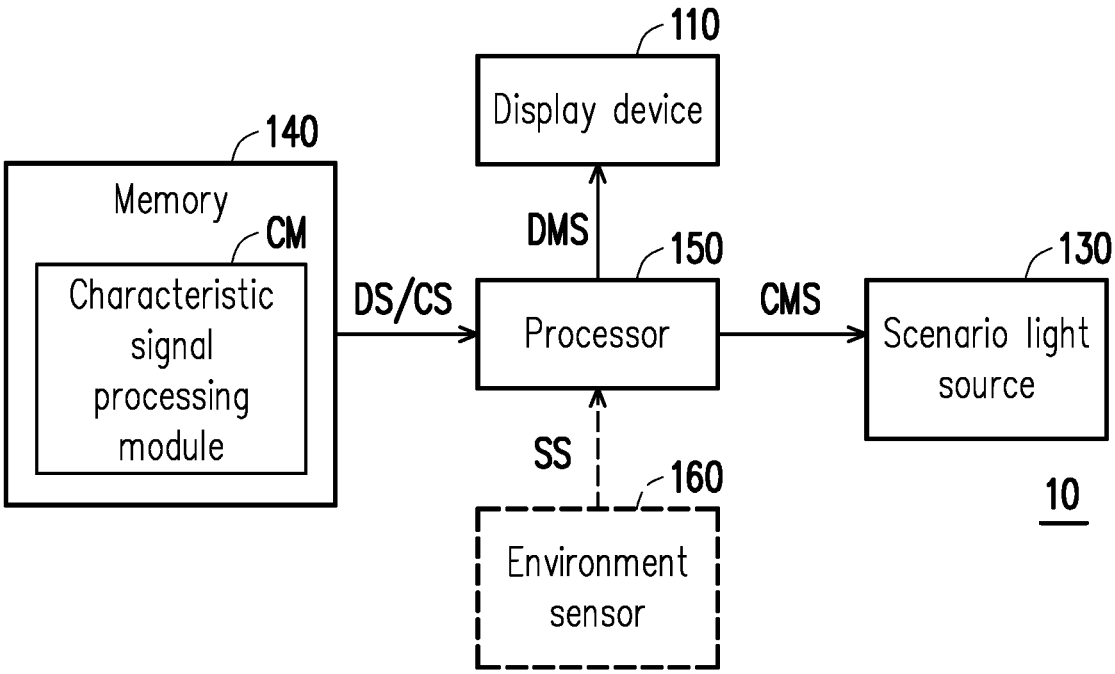
FIG. 3 is a schematic block diagram of a scenario projection system according to an embodiment of the disclosure.
Figure 4:
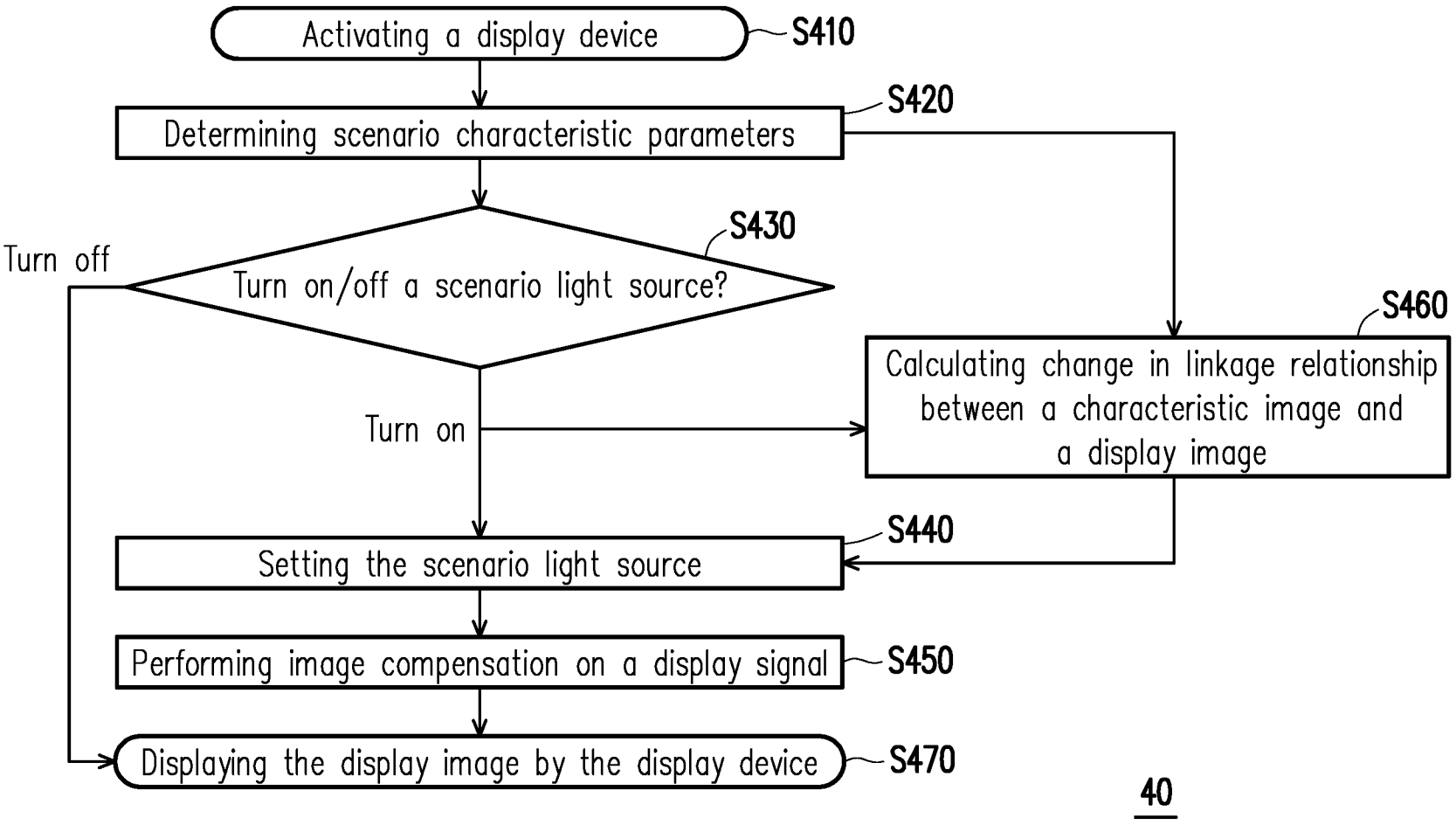
FIG. 4 is a flow chart showing a controlling method of a scenario projection system according to an embodiment of the disclosure.

FIG. 3 is a schematic block diagram of a scenario projection system according to an embodiment of the disclosure. FIG. 4 is a flow chart showing a controlling method of a scenario projection system according to an embodiment of the disclosure. The controlling method 40 of FIG. 4 is adapted for the embodiments of FIG. 1 through FIG. 3, and the controlling method 40 of the present embodiment is further described below with reference to the various component of the scenario projection system 10.

Referring to FIG. 3, the scenario projection system 10 further includes a memory 140 and a processor 150. The memory 140 may be any type of fixed or movable random access memory (RAM), a read-only memory (ROM), a flash memory or the like or a combination of the above components. The processor 150 is, for example, a central processing unit (CPU), or other programmable general-purpose or specific-purpose microprocessor, a digital signal processor (DSP) and the like.

The memory 140 is configured to store a plurality of instructions and a plurality of characteristic signals corresponding to a plurality of scenario characteristic parameters and a plurality of display signals, wherein each of the scenario characteristic parameters includes at least one of time, weather, season, azimuth, scenery, ambient light characteristics, and location. The processor 150 is coupled to the memory 140, the display device 110, and the scenario light source 130, and is configured to execute the instructions to implement the function of the scenario projection system 10.

The processor 150 and the memory 140 may be integrated into the display device 110 or the scenario light source 130, or may exist in the form of an independent host, the disclosure is not limited thereto.

First, in step S410, the display device 110 is turned on, and in step S420, the scenario characteristic parameters are determined. The scenario characteristic parameter may be manually input by the user or automatically selected by the processor 150. According to the scenario characteristic parameter, the processor 150 obtains the corresponding display signal DS and characteristic signal CS from the memory 140, and the scenario light source 130 projects the scenario beam SB according to the characteristic signal CS; accordingly, the display device 110 displays the image DI according to the display signal DS.

For example, the scenario characteristic parameters include, for example: the image content to be displayed by the image DI, such as a window scenery, the time of the image is five o'clock in the evening in the winter of Taiwan, the weather is sunny, the light source object LS of the window scenery is the sun, the object OB is a dead tree nearby the window, as shown in FIG. 2.

After the scenario characteristic parameter is determined, in step S430, the processor 150 may determine whether the scenario light source 130 needs to be turned on. For example, when the scenario characteristic parameter determines that a rainy day scenario is to be presented, then the scenario light source 130 is not turned on, and step S470 is directly performed, so that the screen area DA displays the image DI. In another embodiment, the scenario projection system 10 may further include an environment sensor 160 coupled to the processor 150 for sensing the ambient light in a space where the display device 110 is located, and generating an ambient light characteristic SS. When the environment sensor 160 senses that the space is very bright, the processor 150 may also choose not to turn on the scenario light source 130. Therefore, the scenario projection system 10 of the embodiment also has energy saving effects.

It should be noted that the environment sensor 160 is not required. In another embodiment, the scenario projection system 10 may not include the environment sensor 160.

When the processor 150 determines that the scenario light source 130 needs to be turned on, then step S440 is performed to set the scenario light source 130. The processor 150 may determine the projecting position and projection angle of the scenario light source 130 on the slide rail SR, wherein the projection angle is an included angle between the optical axis of the scenario beam SB and the horizontal line.

Figure 5:
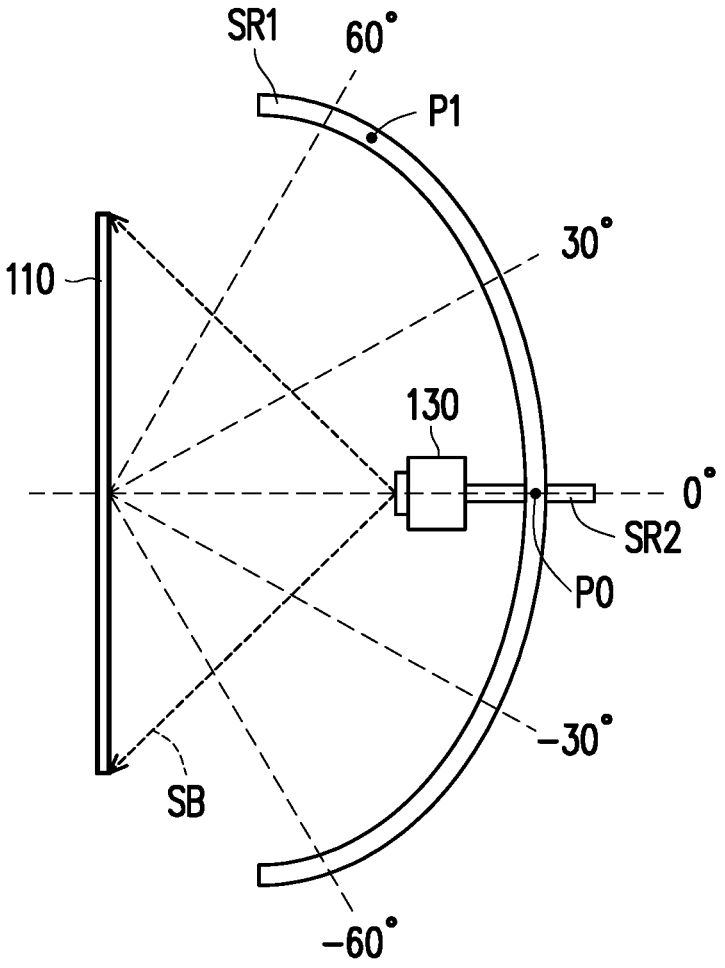
FIG. 5 is a top view of a configuration relationship between a scenario light source and a slide rail according to an embodiment of the disclosure.
Figure 6:
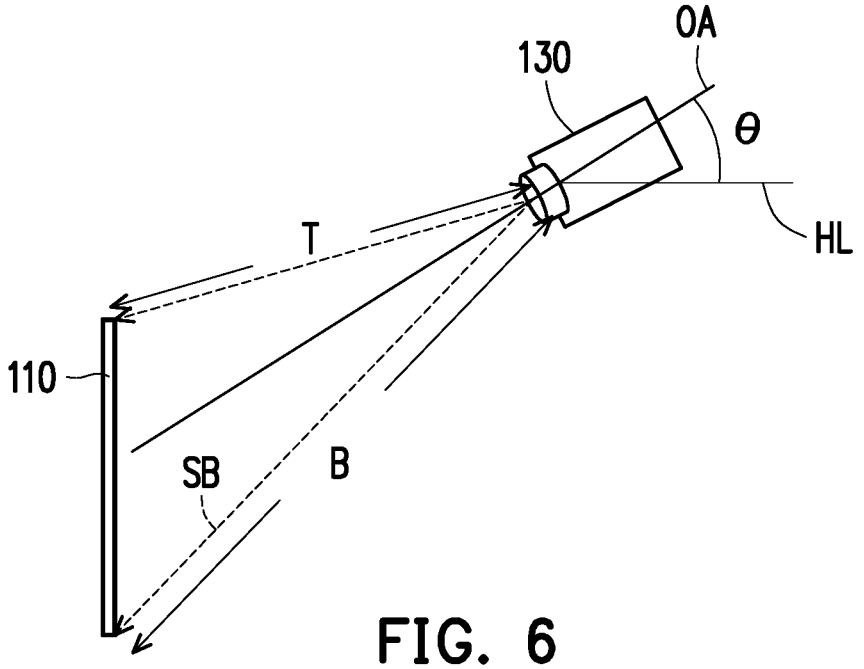
FIG. 6 is a side view of the configuration relationship between the scenario light source and the slide rail in the embodiment of FIG. 5.

FIG. 5 is a top view of a configuration relationship between a scenario light source and a slide rail according to an embodiment of the disclosure. FIG. 6 is a side view of the configuration relationship between the scenario light source and the slide rail in the embodiment of FIG. 5. Referring to FIG. 5 and FIG. 6, the slide rail SR includes a ring-type slide rail SR1 or a radius slide rail SR2, wherein a center of curvature of the ring-type slide rail SR1 is at the center position of the screen area DA, and the radius slide rail SR2 is disposed on the ring-type slide rail SR1, and the track direction of the radius slide rail SR2 is perpendicular to the track direction of the ring-type slide rail SR1. That is, the scenario light source 130 rotates horizontally about the display device 110 along the ring-type slide rail SR1, and the scenario light source 130 changes the projection angle θ between the optical axis OA of the scenario beam SB and the ground G (i.e., horizontal line HL) along the radius slide rail SR2.

In the present embodiment, the scenario characteristic parameter determines that the virtual window to be displayed is five o'clock in the evening in the winter, the virtual window faces the south, it is sunny outside the window and there is a dead tree by the window. Based on the scenario and geographical location, the sun is currently on the west side, so the position of the scenario light source 130 needs to be adjusted to one side of the display device 110, such as the position where the horizontal azimuth angle is 40 to 50 degrees, that is, the projecting position P1. On this occasion, the shadow of the object OB (that is, the dead tree) should be long, so the projection angle of the scenario light source 130 should be small, for example, the projection angle θ is 30 degrees.

Furthermore, the evening sun is typically warm-toned with lower color temperature, so the color temperature of the projection beam SB may be set as 2000K as the warm white color of the bright part of the light and shadow. In addition, when the ambient light characteristic SS shows that the brightness of the indoor illumination light is 30 W (Watt), considering that the light-shadow contrast is usually high on a sunny day, 60 W that is two times the indoor light source is chosen as the light source intensity of the scenario light source 130.

When the scenario light source 130 is not facing the center of the screen area DA, the distance of the scenario beam SB to edges of the screen area DA may be different, so the processor 150 may further perform distortion adjustment on the characteristic signal CS to prevent the projection beam SB from being projected beyond the screen area DA and causing interference.

Figure 7:
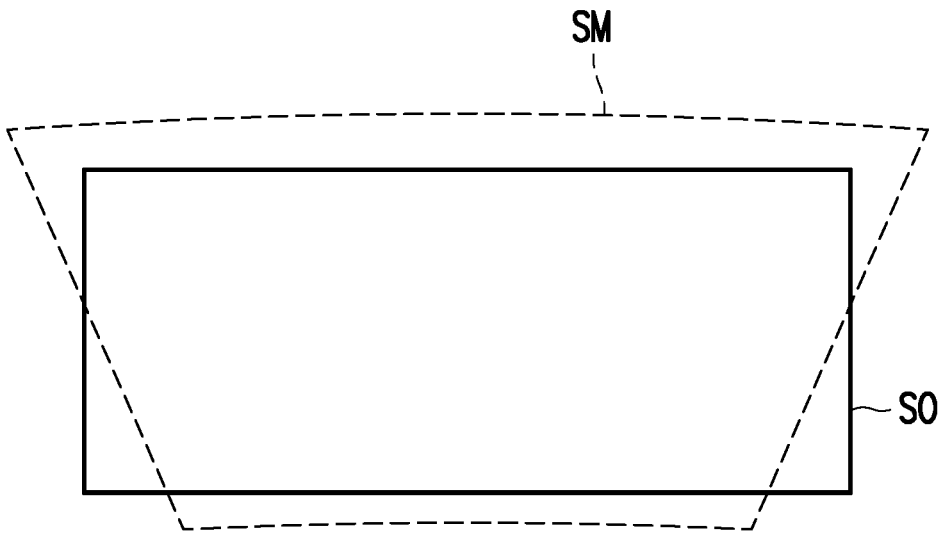
FIG. 7 is a schematic view showing distortion of a scenario beam according to an embodiment of the disclosure.

FIG. 7 is a schematic view showing distortion of a scenario beam according to an embodiment of the disclosure. Referring to FIG. 7, when the horizontal azimuth angle of the scenario light source 130 relative to the screen area DA is 0 degree, as the projecting position P0 shown in FIG. 5, a distance T of the projection beam SB to the upper edge of the screen area DA is smaller than a distance B of the projection beam SB to the lower edge of the screen area DA. The processor 150 adjusts the projection frame size of the projection beam SB from the original S0 (corresponding to the size of the screen area DA) to SM. The implementation method of distortion processing of the projection frame can be obtained by persons having ordinary skill in the art based on the ordinary knowledge, so the details are not repeated herein.

That is to say, the processor 150 may perform distortion adjustment on the characteristic signal CS according to the projecting position P1 and the projection angle θ to generate a characteristic adjusting signal CMS, and the scenario light source 130 projects the scenario beam SB according to the characteristic adjusting signal CMS, so that the illumination range of the scenario beam SB does not exceed the screen area DA.

In an embodiment, the reflective device 120 has a filterability for the incident angle, the polarization state, and the like other than the wavelength. For example, since the scenario light source 130 is located above the reflective device 120, the scenario beam SB is incident into the upper part and lower part of the screen area DA at different incident angles. The processor 150 may also perform brightness compensation on the characteristic signal CS according to the reflectivity distribution of the reflective device 120 to generate the characteristic adjusting signal CMS. Therefore, the scenario light source 130 projects the scenario beam SB according to the characteristic adjusting signal CMS, so that the brightness of the scenario beam SB that is reflected by the reflective device 120 is uniform.

Figure 8:
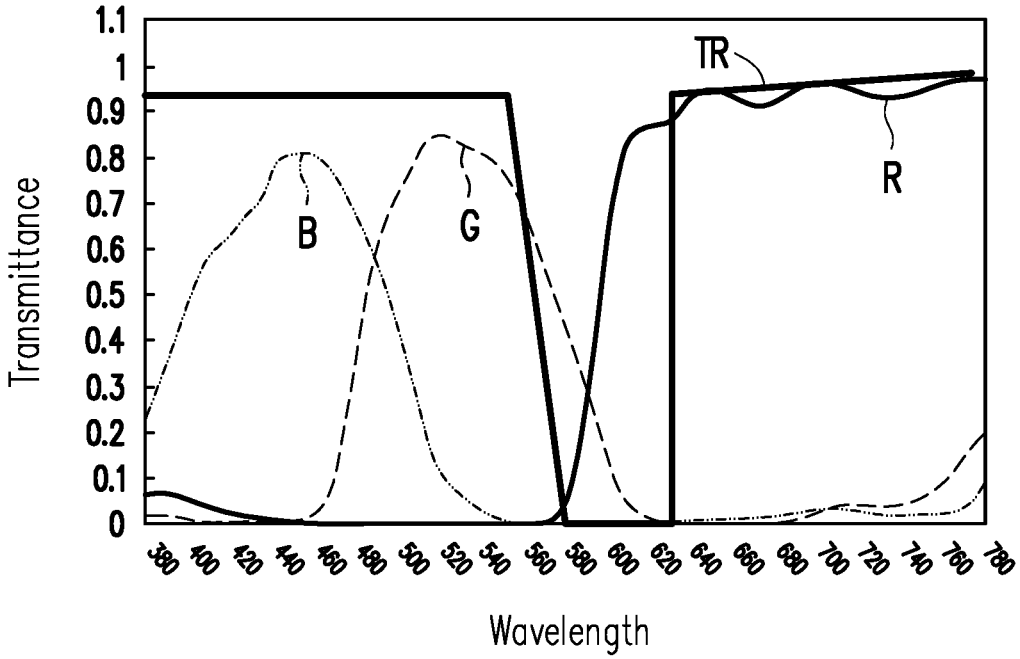
FIG. 8 is a diagram showing transmittance distribution of a reflective device according to an embodiment of the disclosure.

FIG. 8 is a diagram showing transmittance distribution of a reflective device according to an embodiment of the disclosure. Referring to FIG. 8, in the embodiment, the reflective device 120 is a multi-layer coating structure disposed throughout the screen area DA, and the size of which is the same as the screen area DA. The line segments R, G, and B are respectively the spectrum of the red, green and blue beams emitted by the display device 110. The line segment TR is a transmission spectrum of the reflective device 120, and therefore most of the image beam IB can penetrate the reflective device 120. In order to present sunlight, the waveband of the scenario beam SB emitted by the scenario light source 130, for example, falls at 570-590 nm (nanometer) and is reflected by the reflective device 120.

In step S450, the processor 150 performs image compensation on the display signal DS. In this embodiment, the illumination spectrum of the display device 110 and the transmission spectrum of the reflective device 120 are partially overlapped in terms of the red light and the green light, and therefore the processor 150 may perform image compensation on the display signal DS according to the reflectivity distribution of the reflective device 120 to generate the display adjustment signal DMS. In step S470, the display device 110 displays the image DI according to the display adjustment signal DMS to prevent the image quality from being affected by the reflective device 120. In another embodiment, step S410 may be performed after step S450, the disclosure is not limited thereto.

In the embodiment, the scenario projection system 10 may further present the linkage relationship between the characteristic image CI and the image DI that is changed over time.

Figure 9:
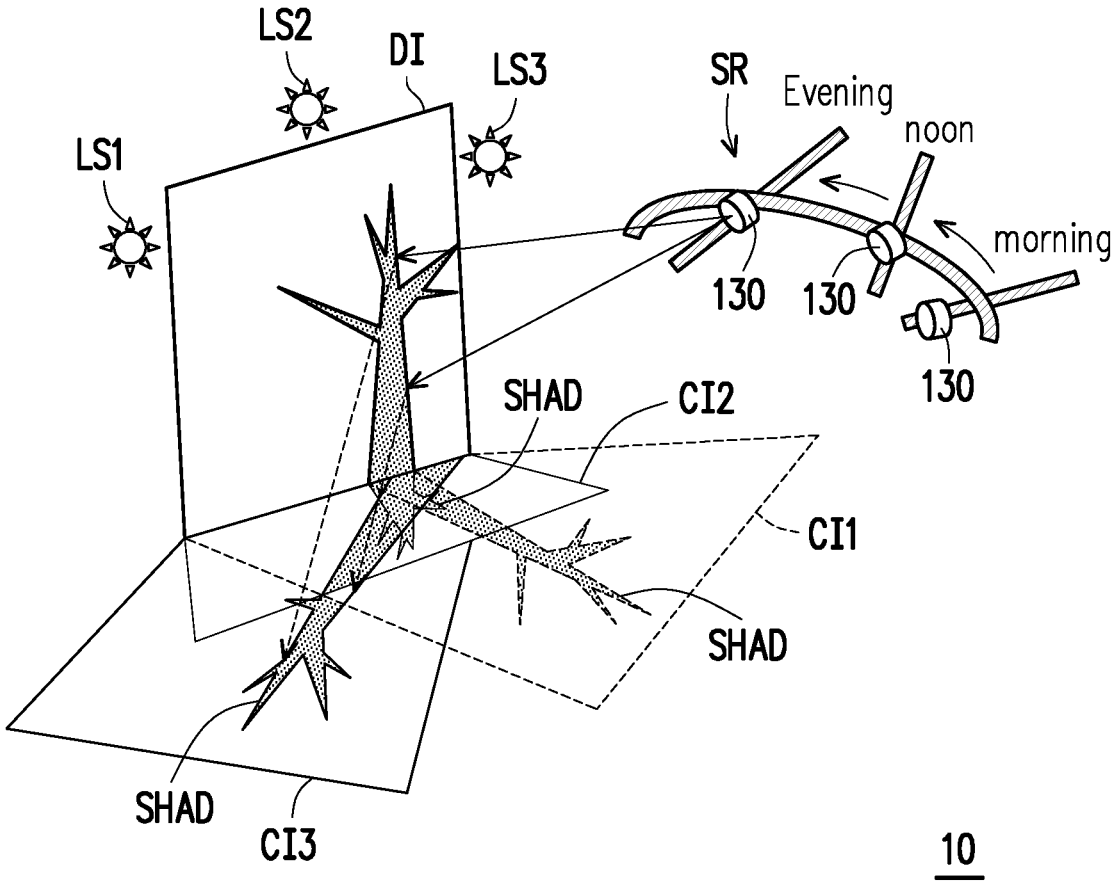
FIG. 9 is a schematic view showing implementation method of a scenario projection system according to another embodiment of the disclosure.

FIG. 9 is a schematic view showing implementation method of a scenario projection system according to another embodiment of the disclosure. Referring to FIG. 9, in step S420, the scenario projection system 10 is set to open, for example, from morning to evening, and set to display a virtual window scene of winter. The virtual window faces the south, it is sunny outside the window and there is a dead tree by the window. The processor 150 receives the display signals DS and the corresponding characteristic signals CS at at least two different time points but presenting the same scene from the memory 140. Herein, eight o'clock in the morning, twelve o'clock at noon time, and five o'clock in the evening are used as an example. The light source objects are LS1, LS2, and LS3, which respectively represent the morning sun, the noon sun, and the evening sun. The corresponding characteristic signals are CS1, CS2, and CS3, respectively. The characteristic images projected by the scenario light source 130 on the ground are C11 C12 and C13 respectively, showing that the shadow of the dead tree is illuminated from the window into the room.

In step S460, the processor 150 may calculate a change in the linkage relationship between the characteristic image CI and the display image DI. Specifically, the processor 150 may estimate the characteristic signals between 8 am and 12 noon according to the characteristic signals CS1 and CS2, and estimate the characteristic signals between 12 noon and 5 o'clock in the evening according to the characteristic signals CS2 and CS3, thereby generating characteristic images that change continuously during this period of time. Specifically, the memory 140 stores a characteristic signal processing module CM, and the processor 150 executes the characteristic signal processing module CM to change the projecting position, projection angle and characteristic image of the scenario light source 130 over time, for example, the change is made every 15 minutes to show that the sunlight of the sun is changed over time. In the meantime, the change of the shadow SHAD of the dead tree is estimated correspondingly, because as the angle of the projection light of the scenario light source 130 is changed, the shadow SHAD of the dead tree should also exhibit the effect of changing with the angle of light.

In this manner, the scenario projection system 10 does not need to store a large amount of characteristic signals, and the processor 150 may estimate the characteristic signal changes between at least two different time points according to the characteristic signals CS at the at least two different time points, and the scenario light source 130 is able to correspondingly generate different characteristic images at the at least two different time points.

Figure 10:
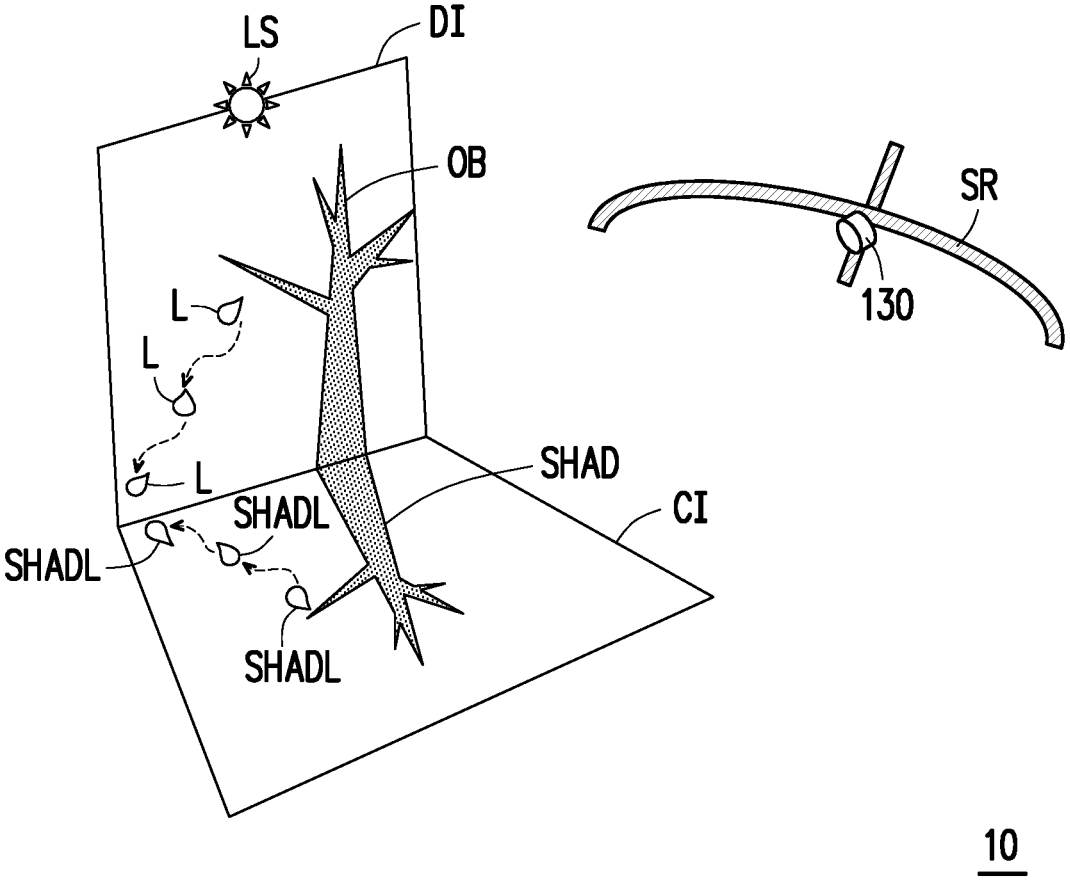
FIG. 10 is a schematic view showing implementation method of a scenario projection system according to still another embodiment of the disclosure.

FIG. 10 is a schematic view showing implementation method of a scenario projection system according to still another embodiment of the disclosure. In addition to time changes, the scenario projection system 10 may also present other changes to increase sense of reality, such as wind blowing leaves, moving people/objects or falling leaves. In the embodiment of FIG. 10, the object OB is a tree, and display device 110 plays a continuous image of a leaf L falling from the tree. In the embodiment, since the scene changes little, only the position of the leaf L is changed, and therefore the processor 150 may execute the characteristic signal processing module CM to calculate the change of shadow SHADL of the leaf when the leaf L moves, such that scenario beam SB projected by the scenario light source 130 is controlled to simultaneously show the shadow changes of the falling leaf L.

In summary, the embodiments of the disclosure provide a scenario projection system and a controlling method thereof. The scenario light source projects the scenario beam on the screen area of the display device, and is reflected to the outside of the screen area by the reflective device disposed in the screen area to simulate the light emitted by the light source object in the image, wherein the characteristic image in the scenario beam may show the light-shadow variation that is caused by light from the light source object hitting the object. In this manner, in addition to the image displayed in the screen area, the projected characteristic image may extend the image effect of the display device to the outside of the screen area, and therefore the virtual scenario presented by the scenario projection system and the controlling method thereof provided in the embodiments of the disclosure creates high sense of reality.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A scenario projection system, comprising:

a display device, configured to display an image in a screen area of the display device;

a reflective device, configured in the screen area; and a scenario light source, configured on a slide rail to project a scenario beam to the screen area, and the scenario beam is reflected by the reflective device to form a characteristic image outside the screen area, wherein the characteristic image has a linkage relationship with the image, wherein the image comprises a light source object and at least one object, and the linkage relationship comprises:

a projecting position of the scenario light source on the slide rail corresponding to a mirror position of the light source object relative to the screen area; and the characteristic image showing light-shadow variation caused by light from the light source object hitting the object.

2. The scenario projection system according to claim 1, wherein the scenario beam has directivity.

3. The scenario projection system according to claim 1, further comprising:

a memory, storing a plurality of instructions and a plurality of characteristic signals and a plurality of display signals corresponding to a plurality of scenario characteristic parameters, wherein each of the scenario characteristic parameters comprises at least one of time, weather, season, azimuth, scenery, ambient light characteristic, and location; and a processor, coupled to the memory, the display device and the scenario light source, configured to execute the instructions to:

determine, according to at least one of the scenario characteristic parameters, a projecting position and a projection angle of the scenario light source on the slide rail, wherein the projection angle is an included angle between an optical axis of the scenario beam and a horizontal line; and make, according to at least one of the scenario characteristic parameters, the scenario light source to project the scenario beam based on a corresponding at least one of the characteristic signals, and make the display device to display the image according to a corresponding at least one of the display signals.

4. The scenario projection system according to claim 3, wherein at least two of the characteristic signals are related images at at least two different time points, and the processor is further configured to execute the instructions to:

estimate the characteristics signal changes between the at least two different time points according to the characteristic signals at the at least two different time points, and make the scenario light source to correspondingly generate the different characteristic images at the at least two different time points.

5. The scenario projection system according to claim 3, wherein the processor is further configured to execute the instructions to:

perform a distortion adjustment on the corresponding characteristic signal according to the projecting position and the projection angle to generate a characteristic adjustment signal, wherein the scenario light source projects the scenario beam according to the characteristic adjustment signal, such that an illumination range of the scenario beam does not exceed the screen area.

6. The scenario projection system according to claim 3, further comprising:

an environment sensor, coupled to the processor to sense an ambient light of a space where the display device is located, and generate the ambient light characteristic.

7. The scenario projection system according to claim 3, wherein the processor is further configured to execute the instructions to:

perform a brightness compensation on the corresponding characteristic signal according to a reflectivity distribution of the reflective device to generate a characteristic adjustment signal, wherein the scenario light source projects the scenario beam according to the characteristic adjustment signal, such that brightness of the scenario beam reflected by the reflective device is uniform.

8. The scenario projection system according to claim 1, wherein a projecting position of the scenario light source disposed on the slide rail is higher than the display device, and an optical axis of the scenario beam is aligned with the center of the screen area.

9. The scenario projection system according to claim 1, wherein the slide rail comprises a ring-type slide rail or a radius slide rail, wherein a center of curvature of the ring-type slide rail is at a center position of the screen area, the radius slide rail is disposed on the ring-type slide rail, and a track direction of the radius slide rail is perpendicular to a track direction of the ring-type slide rail.

10. The scenario projection system according to claim 1, wherein a plane of the image is perpendicular to a plane of the characteristic image.

11. A controlling method of a scenario projection system, the scenario projection system comprising a display device, a reflective device disposed in a screen area of the display device, and a scenario light source disposed on a slide rail, the controlling method comprising:

making the screen area display an image; and making the scenario light source to project a scenario beam to the screen area, and the scenario beam is reflected by the reflective device to form a characteristic image outside the screen area, wherein the characteristic image has a linkage relationship with the image, wherein the image comprises a light source object and at least one object, and the linkage relationship comprises:

a projecting position of the scenario light source on the slide rail corresponding to a mirror position of the light source object relative to the screen area; and the characteristic image showing light-shadow variation caused by light from the light source object hitting the object.

12. The controlling method according to claim 11, wherein the scenario beam has directivity.

13. The controlling method according to claim 11, wherein the step of making the screen area to display the image and making the scenario light source to project the scenario beam comprises:

determining, according to a scenario characteristic parameter, a projecting position and a projection angle of the scenario light source on the slide rail, wherein the projection angle is an included angle between an optical axis of the scenario beam and a horizontal line, wherein the scenario characteristic parameter comprises at least one of time, weather, season, azimuth, scenery, ambient light characteristic, and location; and making, according to the scenario characteristic parameter, the scenario light source to project the scenario beam based on a corresponding characteristic signal, and making the display device to display the image according to a corresponding display signal.

14. The controlling method according to claim 13, further comprising:

at least two of the characteristic signals being related images at at least two different time points respectively; and estimating characteristics signal changes between the at least two different time points according to the characteristic signals of the at least two different time points, and making the scenario light source to correspondingly generate the different characteristic images at the at least two different time points.

15. The controlling method according to claim 13, wherein the step of making the scenario light source to project the scenario beam to the screen area further comprises:

performing a distortion adjustment on the corresponding characteristic signal according to the projecting position and the projection angle to generate a characteristic adjustment signal, wherein the scenario light source projects the scenario beam according to the characteristic adjustment signal, such that an illumination range of the scenario beam does not exceed the screen area.

16. The controlling method according to claim 13, wherein the step of making the scenario light source to project the scenario beam further comprises:

performing a brightness compensation on the corresponding characteristic signal according to a reflectivity distribution of the reflective device to generate a characteristic adjustment signal, wherein the scenario light source projects the scenario beam according to the characteristic adjustment signal, such that brightness of the scenario beam reflected by the reflective device is uniform.

17. The controlling method according to claim 11, wherein a projecting position of the scenario light source disposed on the slide rail is higher than the display device, and an optical axis of the scenario beam is aligned with the center of the screen area.

18. The controlling method according to claim 11, wherein the slide rail comprises a ring-type slide rail or a radius slide rail, wherein a center of curvature of the ring-type slide rail is at a center position of the screen area, the radius slide rail is disposed on the ring-type slide rail, and a track direction of the radius slide rail is perpendicular to a track direction of the ring-type slide rail.

19. The controlling method according to claim 11, wherein the step in which the scenario beam is reflected by the reflective device to form in the characteristic image outside the screen area comprises:

a direction of the scenario beam reflected by the reflective device faces ground.

20. The controlling method according to claim 11, wherein a plane of the image is perpendicular to a plane of the characteristic image.

* * * * *